US005944617A

United States Patent [19]

Falone et al.

[11] Patent Number: 5,944,617

[45] **Date of Patent: *Aug. 31, 1999**

[54] VIBRATION ABSORBING MATERIAL FOR HANDLES OF SPORTING EQUIPMENT

[75] Inventors: Thomas Falone, Mickleton, N.J.; Richard S. Wyerman, Doylestown, Pa.

[73] Assignee: Pendulum Corporation, Media, Pa.

[ * ] Notice: This patent is subject to a terminal disclaimer.

[21] Appl. No.: 08/868,357

[22] Filed: Jun. 3, 1997

Related U.S. Application Data

[63] Continuation-in-part of application No. 08/560,699, Nov. 20, 1995, Pat. No. 5,653,643.

[51] Int. Cl.[6] ..... A63B 53/14

[52] U.S. Cl. ..... 473/300; 473/523; 473/549; 473/568; 473/316

[58] Field of Search ..... 473/316, 321, 473/300, 303, 523, 549, 568

[56] References Cited

U.S. PATENT DOCUMENTS

| | | | |
|---|---|---|---|
| 1,195,994 | 8/1916 | Lard | 473/316 |
| 1,551,203 | 8/1925 | Mills | 473/322 |
| 1,620,118 | 3/1927 | Mattern . | |
| 2,871,899 | 2/1959 | Coyle | 81/177.1 |
| 3,353,981 | 11/1967 | Jacob . | |
| 3,606,326 | 9/1971 | Sparks et al. . | |
| 3,716,433 | 2/1973 | Plummer | 156/85 |
| 4,143,109 | 3/1979 | Stockum . | |
| 4,147,443 | 4/1979 | Skobel . | |
| 4,197,611 | 4/1980 | Bell et al. . | |
| 4,261,367 | 4/1981 | Uffindell . | |
| 4,268,574 | 5/1981 | Peccenini et al. . | |
| 4,338,270 | 7/1982 | Uffindell . | |
| 4,417,042 | 11/1983 | Dziark . | |
| 4,483,972 | 11/1984 | Mitchell . | |
| 4,552,713 | 11/1985 | Cavicchioli . | |
| 4,591,160 | 5/1986 | Piragino . | |
| 4,597,578 | 7/1986 | Lancaster . | |
| 4,613,537 | 9/1986 | Krupper . | |
| 4,660,832 | 4/1987 | Shomo . | |
| 4,819,939 | 4/1989 | Kobayashi | 473/299 |
| 4,948,131 | 8/1990 | Nakanishi . | |
| 4,953,862 | 9/1990 | Uke et al. . | |
| 5,042,804 | 8/1991 | Uke et al. . | |
| 5,088,734 | 2/1992 | Glava . | |
| 5,110,653 | 5/1992 | Landi . | |
| 5,122,405 | 6/1992 | Landi . | |
| 5,137,769 | 8/1992 | Landi . | |
| 5,193,246 | 3/1993 | Huang . | |
| 5,199,706 | 4/1993 | Chen . | |
| 5,203,561 | 4/1993 | Lanctot . | |
| 5,240,247 | 8/1993 | Didier . | |
| 5,254,391 | 10/1993 | Davis . | |
| 5,258,088 | 11/1993 | Wu . | |
| 5,261,665 | 11/1993 | Downey . | |
| 5,267,487 | 12/1993 | Falco et al. . | |

(List continued on next page.)

OTHER PUBLICATIONS

*American Journal of Physics,* vol. 38, No. 5 (May 1970), "On the Dynamics of the Swing of a Golf Club".

*Primary Examiner*—Jeanette Chapman
*Assistant Examiner*—Stephen L. Blau
*Attorney, Agent, or Firm*—Connolly & Hutz

[57] ABSTRACT

A hand held article, such as a golf club, includes an elongated handle with an inner support structure mounted to the handle and a vibration absorbing material mounted around the inner support structure. The inner support structure includes a plurality of spaced rigid projections which extend into the vibration absorbing material to a location inwardly of the outer surface of the vibration absorbing material. In one embodiment the inner support structure is integral with the shaft of the handle. In another embodiment a sleeve is heat shrunk onto the shaft and the inner support structure and vibration absorbing material are mounted over the sleeve.

27 Claims, 3 Drawing Sheets

U.S. PATENT DOCUMENTS 5,269,516 12/1993 Janes ..... 473/523
5,282,618 2/1994 Hong .
5,322,285 6/1994 Turner .
5,333,861 8/1994 Mills .
5,348,303 9/1994 Swissheim ..... 473/201
5,355,552 10/1994 Huang .
5,362,046 11/1994 Sims .
5,435,549 7/1995 Chen .
5,524,885 6/1996 Heo ..... 473/299
5,575,473 11/1996 Turner ..... 473/298
5,653,643 8/1997 Falone ..... 473/300
5,686,158 11/1997 Gibbon .
5,695,408 12/1997 DeLaCruz ..... 473/300
5,730,662 3/1998 Rens ..... 473/300
5,749,798 5/1998 Kuebler ..... 473/549

VIBRATION ABSORBING MATERIAL FOR HANDLES OF SPORTING EQUIPMENT

CROSS-REFERENCE TO RELATED APPLICATION

This application is a continuation in part of application Ser. No. 08/560,699, filed Nov. 20, 1995, now U.S. Pat. No. 5,653,643.

BACKGROUND OF THE INVENTION

U.S. application Ser. No. 560,699, filed Nov. 20, 1995, now U.S. Pat. No. 5,653,643 discloses techniques involving the provision of vibration absorbing material for handles of sporting equipment. A particularly useful example of such equipment is golf clubs wherein the vibration absorbing material is provided on the gripping area of the club. Other types of sporting equipment and devices having handles to be gripped also may incorporate the vibration absorbing material.

The techniques disclosed in Ser. No. 560,699 include the provision of an inner core around the shaft of the handle in the gripping area. The inner core has a plurality of spaced rigid projections provided in the gripping area to thereby provide rigidity during use of the article. The vibration absorbing material surrounds the inner core with its support structure so that the vibration absorbing material is the sole material contacted by the user when gripping the handles during the use of the article. The vibration absorbing material has various characteristics which are particularly desirable for use of the article.

SUMMARY OF THE INVENTION

An object of this invention is to provide variations in the techniques and structures disclosed in application Ser. No. 560,699.

In accordance with one embodiment of this invention the inner core is integral with the shaft and includes its integral inner support structure having the plurality of spaced rigid projections which extend in a pattern longitudinally down the length of the gripping area. The pattern may be longitudinal fins, horizontal fins or any other type of pattern. The vibration absorbing material is disposed over the inner support structure in the manner of application Ser. No. 560,699.

In a further embodiment of this invention a sleeve is heat shrunk onto the shaft and the combined inner core and outer vibration absorbing material is then secured over the sleeve. The sleeve may contain an adhesive either as a separate material or from the tackiness of the sleeve when the sleeve is heated to assist in mounting the combined inner core and outer vibration absorbing material on the sleeve.

THE DRAWINGS

DETAILED DESCRIPTION

The present invention involves variations in the techniques shown in U.S. application Ser. No. 560,699 filed Nov. 20, 1995. All of the details of that application are incorporated herein by reference thereto. The present description will be based primarily upon the variations to those techniques.

Figure 1:
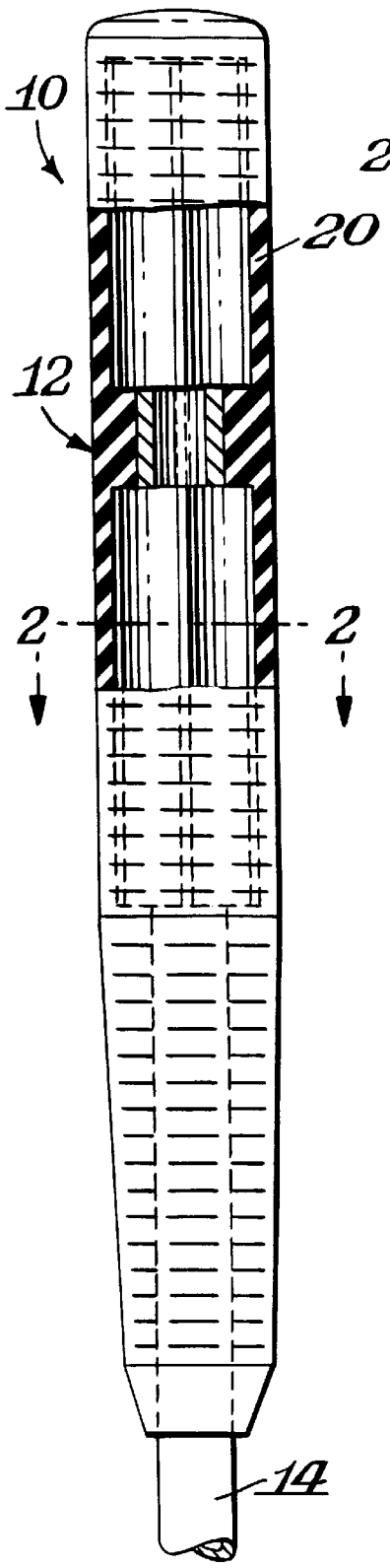
FIG. 1 is a side elevational view partly in section of an elongated handle of athletic equipment, such as a golf club, in accordance with this invention.
Figure 2:
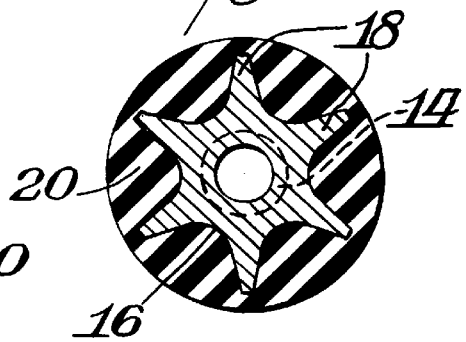
FIG. 2 is a cross sectional view taken through FIG. 1 along the line 2—2.

FIGS. 1–2 illustrate a handle 10 of a hand held article, such as an article of athletic equipment, which includes a gripping area 12 extending from the outer end of the handle around a portion of a shaft 14. The gripping area would be gripped by the user in a squeezing action.

In the embodiment of FIGS. 1–2 the shaft 14 has an integral inner core 16 which includes an inner support structure in the form of projections 18 around and integral with the inner core. The shaft and inner core may be made of metal, graphite or a suitable plastic. The invention may be practiced where the inner core 16 and shaft 14 are actually made of separate materials permanently secured together such as by welding or any other permanent form of fastening. Thus, it might be possible, for example, to form the inner core 16 of a nylon or other suitable plastic material as an insert which would be permanently secured to the shaft so that the inner core and shaft are functionally integral.

The inner support structure has a plurality of spaced rigid projections 18 in the manner described in application Ser. No. 560,699. A flexible vibration absorbing material 20 is provided around inner core 16.

Vibration absorbing material 20 has an outer surface which comprises the gripping surface of the handle. The vibration absorbing material is made of the material disclosed in application Ser. No. 560,699 and includes various characteristics that make it particularly desirable to function as a gripping material. For example, the outer surface of the vibration absorbing material 20 is non-porous and tacky. The material 20, itself has a hardness of less than 40 durometer reading from a Durometer Class D device. A coefficient of friction of at least 0.6 (preferably 0.6–1.0) and a dampening of vibration greater than 55% as derived from Accelerometer Testing using Lab Tech Software.

Where the vibration absorbing material 20 is thin, such as by being on an inner core having relatively small rigid projections 18, the hardness could have an upper limit of 60 durometer reading and the minimum dampening of vibration could be 25%. Accordingly, the hardness is preferably less than 40 durometer reading but can be as high as 60 durometer reading and the dampening of vibration is preferably greater than 55%, but can be as low as 25% with the invention being broadly practiced with values between those hardness and dampening of vibration parameters.

Materials which have characteristics usable with the invention are silicone such as silicone sealants and similar type polymer acrylic and modified rubber compounds. Reference is made to U.S. Pat. Nos. 4,483,972 and 4,417,042 the details of which are incorporated herein by reference thereto with regard to the composition of suitable materials.

As best shown in FIG. 2 the inner support structure which includes the projections 18 is located inwardly of the outer surface of the vibration absorbing material 20. The vibration absorbing material 20 and the inner support structure are secured together by the projections 18 extending into the vibration absorbing material 20. The projections 18 are spaced peaks with spaced valleys therebetween. The vibration absorbing material is distinct and separable from the inner support structure. As also shown in FIG. 2 the vibration absorbing material 20 completely covers the projections 18 to render the outer surface of the vibration absorbing material as the sole user contacting and gripping surface in the gripping area during use of the article.

The rigid projections 18 of the inner support structure 16 are arranged in a pattern which extends longitudinally the length of the gripping area. The projections may be fins, ribs or channels and can be uniformly, randomly or otherwise strategically placed on the surface of the inner structure. In a preferred practice of the invention the projections are longitudinal with respect to the longitudinal axis of the shaft. The invention, however, may be practiced where the projections are horizontal or in other orientations creating, for example, a patterned configuration. In the preferred practice of the invention, however, regardless of the disposition of the projections, the projections should be located along the length of the gripping area as viewed longitudinally with regard to the longitudinal axis of the shaft thereby providing rigidity during use of the article. Thus, in use of the article there would be, for example, both lateral and longitudinal rigidity as a result of the rigid projections.

The thickness of the projections could be uniform patterned or of tapered design, height and thickness.

The embodiment of FIGS. 1–2 is particularly useful with a golf club. By having the premolded shaft bearing the design characteristics of the inner structure, the overall weight of the grip can be reduced from 35–50 grams down to 15–35 grams. Preferably, adhesives are added to the outer surface of the inner core to assure a firm securement of the outer grip.

As shown, for example, in FIGS. 2, 4–6 and 15 the rigid projections of the inner core are in the form of a continuous series of peaks and valleys. The thickness of the vibration absorbing material 20 at each valley is greater than twice the thickness at the peaks. The outer ends of the peaks are closer to the outer surface of material 20 than any other portion of the inner core is to the outer surface.

FIGS. 3–19 illustrate a further embodiment of this invention wherein the shaft 14 is provided with a sleeve 30, with some of the figures showing components of the embodiment. The inner core 16 in turn surrounds sleeve 30 with the outer core or gripping material 20 around inner core 16. Gripping material 20 would have the same characteristics as in the embodiment of FIGS. 1–2. This variation of the invention would essentially be similar to that disclosed in application Ser. No. 560,699 except that this variation of the invention includes the sleeve between the inner core and shaft.

In this embodiment the inner structure has a Durometer Class D Device reading of between 0.25 and 0.95 and has a more rigid stiffer feel to the material than the outer structure 20, but is not brittle.

Figure 6:
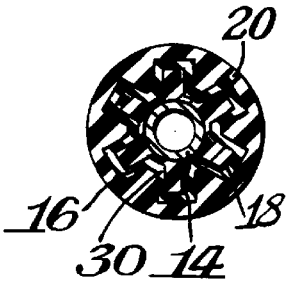
FIGS. 5–6 are views similar to FIG. 4 showing alternative inner core structure.
Figure 3:
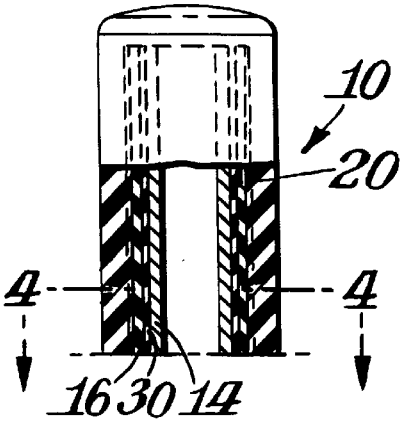
FIG. 3 is a side elevational view partly in section of a modified form of handle of athletic equipment, such as a golf club, in accordance with this invention.
Figure 4:
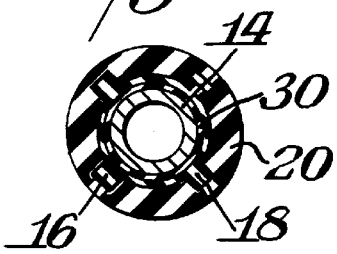
FIG. 4 is a cross-sectional view taken through FIG. 3 along the line 4—4.
Figure 5:
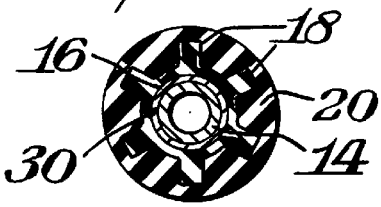

FIGS. 4–6 and 9 illustrate various structures for the inner core 16 with its projections 18 which create spaced peaks (projections) and valleys therebetween. The inner surface of the grip material 20 would complement the outer surface of inner core 16 to accommodate the projections 18. Similarly, as illustrated in FIG. 6 sleeve 30 could have a non-cylindrical outer surface which complements the inner surface of inner core 16. Alternatively, as shown in FIGS. 4–5 the outer surface of sleeve 30 and the inner surface of inner core 16 could complement each other by both surfaces being cylindrical.

Figure 7:
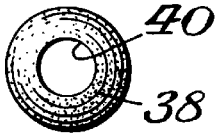
FIG. 7 is a top plan view of the inner core used in the embodiment of FIGS. 3–4.
Figure 10:
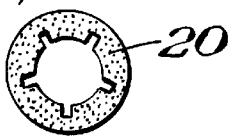
FIG. 10 is a top plan view of the gripping structure or outer core used in the embodiment of FIGS. 3–4.
Figure 8:
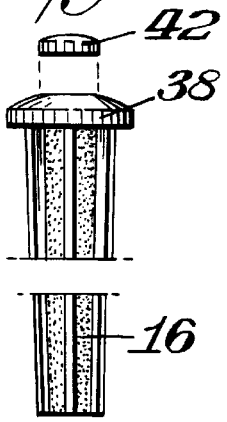
FIG. 8 is a front elevational view of the inner core shown in FIG. 7 illustrating how a cap is attached.
Figure 11:
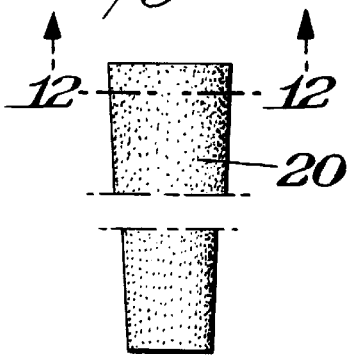
FIG. 11 is a side elevational view of the gripping structure shown in FIG. 10.
Figure 13:
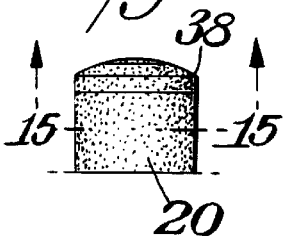
FIG. 13 is a side elevational view of a portion of the combined inner core and outer core or gripping structure shown in FIGS. 7–12.
Figure 14:
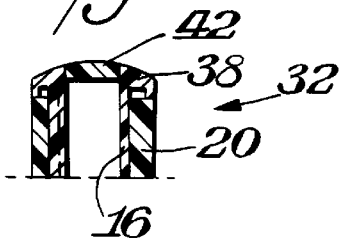
FIG. 14 is a cross sectional view in elevation of the combined structure shown in FIG. 13 with the sleeve and shaft omitted.
Figure 9:
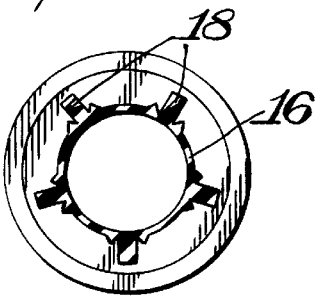
FIG. 9 is a cross sectional view of the inner core shown in FIG. 8.
Figure 12:
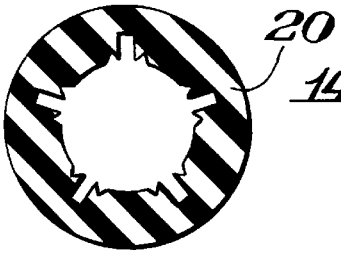
FIG. 12 is a cross-sectional view taken through FIG. 11 along the line 12—12.
Figure 15:
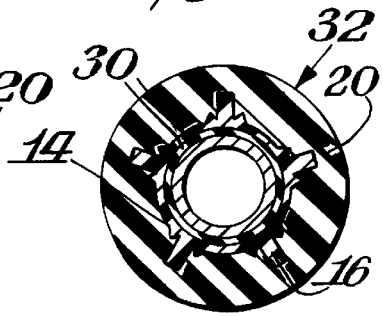
FIG. 15 is a cross sectional view taken through FIG. 13 along the line 15—15 also showing the sleeve and shaft.

The structure of the inner core 16 and its projections 18 is illustrated in FIGS. 7–9. FIGS. 10–12 illustrate the gripping structure 20 that would fit around inner core 16. FIG. 14 illustrates the inner core 16 and gripping structure 20 in its assembled condition, while FIG. 15 illustrates the final assembly which also includes the shaft 14 and sleeve 30.

Figure 16:
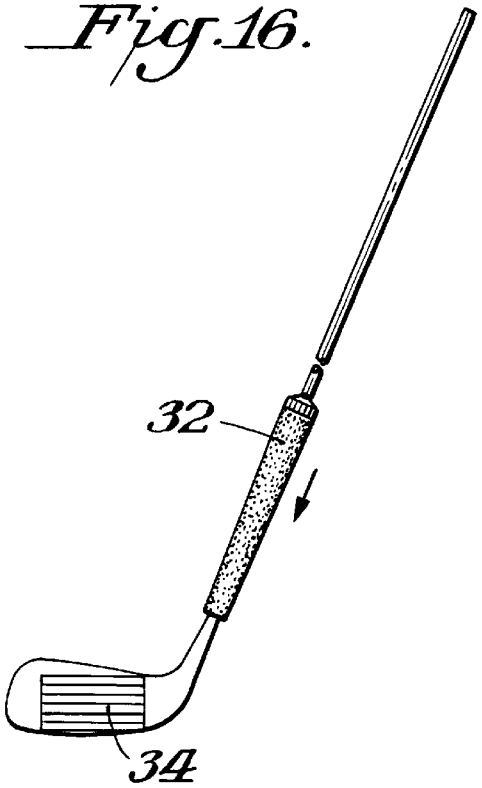
FIGS. 16–19 are side elevational views showing steps in the mounting of the components to a golf club shown in FIGS. 3–15 in accordance with this invention.

FIGS. 16–19 illustrate a preferred practice of the invention for mounting the components of the second embodiment. Initially the inner core 16 and outer core or gripping material 20 would be molded together to form the combined unit or outer structure indicated by the reference numeral 32. As shown in FIG. 16 the outer structure 32 is slid down the shaft past the grip area and can slide, for example, all the way down to the club head 34.

Figure 17:
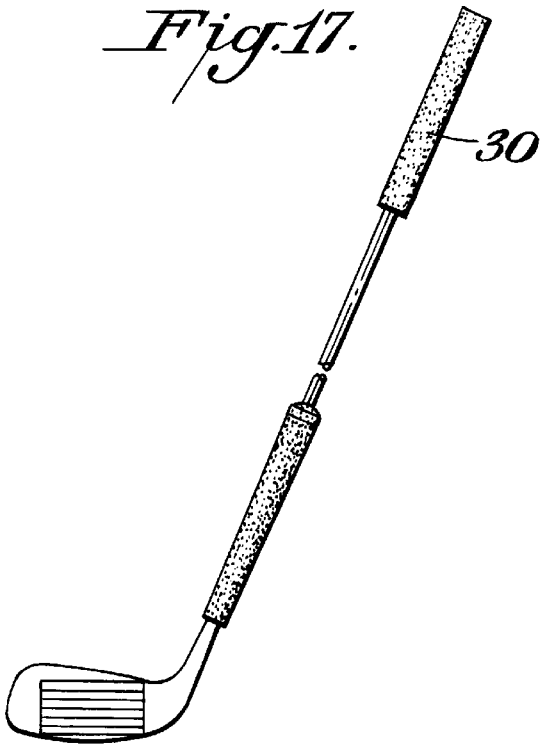

The sleeve 30 would then be slid over the end of the shaft and aligned with the very top edge of the shaft as shown in FIG. 17. Sleeve 30 is preferably of uniform thickness and cylindrical in shape when mounted on a cylindrical shaft. When mounted on other types of equipment, such as a baseball bat, the sleeve would have a conforming shape, but still is preferably uniform in thickness.

Figure 18:
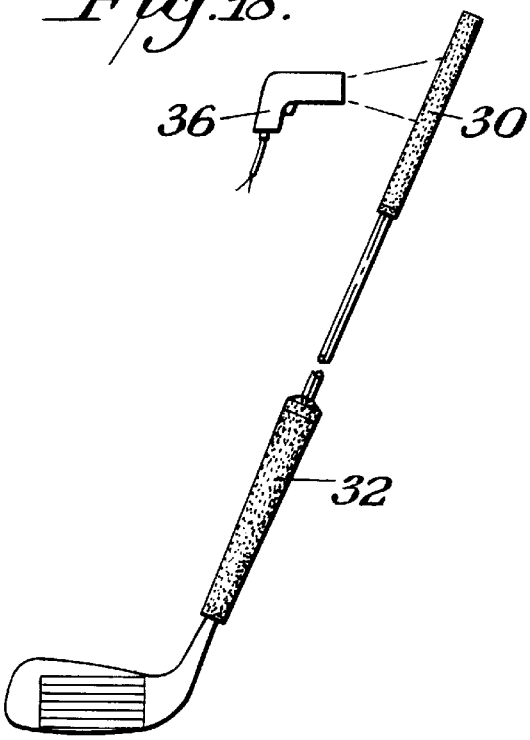

After the sleeve is properly located on the shaft, the sleeve is heated. In a preferred practice of the invention a conventional hair dryer 36 could be used as shown in FIG. 18 to heat and shrink the sleeve. Preferably, any suitable material such as a suitable plastic, polymer or silicone could be used for the sleeve 30 wherein the material is heat shrunk to firmly grip the shaft by being heated at a temperature of at least 120° F. If desired, adhesive could be applied around the shaft which is activated by the heat to further assure firm securement of the sleeve to the shaft.

Figure 19:
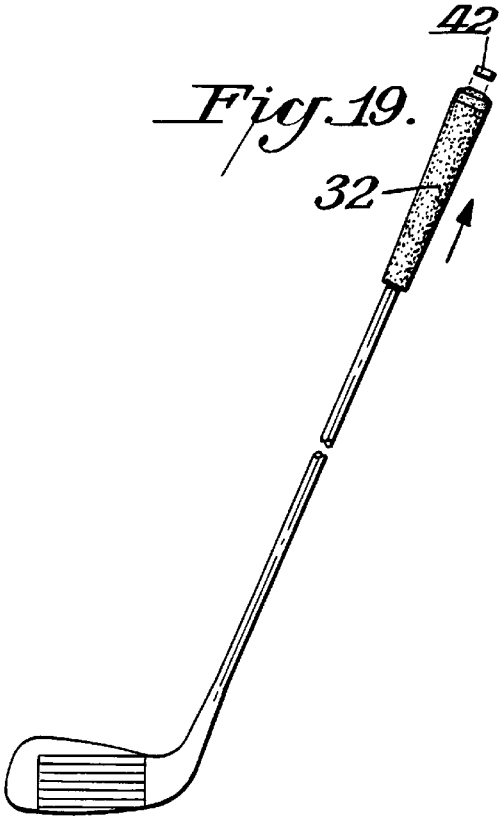

Once the sleeve 30 is heat shrunk onto the shaft, the outer structure 32 is slid upwardly over the sleeve 30 until the upper edge of the outer structure 32 is generally coterminous with the upper edge of the sleeve and shaft as shown in FIG. 19. If desired, a mild adhesive may be provided on the outer surface of the sleeve, either as a separate material or as a result of tackiness from the sleeve material wherein the tackiness is created by heating the sleeve.

As shown in FIGS. 7 and 8 the outer end 38 of the inner core 16 includes a recess 40 for receiving a cap 42. Accordingly, as shown in FIG. 19, once the outer structure 32 is mounted over the sleeve 30 the cap 42 is then snapped into the recess to provide a finished outer end of the club. Cap 42 may be custom made to carry a monogram, corporate logo or other markings.

The provision of the sleeve 30 is advantageous not only in providing a manner of securing the gripping structure to the handle but also functions to hide imperfections in the shaft due to tape residue, dents, chips, scratches, etc. The use of the sleeve 30 which is heat shrunk provides a strong lock of the sleeve 30 to the shaft 14 wherein the heat shrunk sleeve 30 is locked in size and does not expand. The sleeve 30 thus maintains its structural features when shrunk to the shaft. This embodiment of the invention thus provides techniques where one size fits all golf club shafts. The invention also eliminates the need for tape, while the use of adhesives are optional.

Although the invention has been particularly described with respect to golf clubs the invention may also be practiced with other equipment having a grip area. Examples are athletic equipment such as racquets (tennis, racquetball, squash, etc.), hockey (field, ice, street, etc.), bats, javelins, lacrosse sticks, etc. Other examples are tools (shovels, rakes, brooms, hammers, wrenches, pliers, screwdrivers, knives, etc.) or handlebars or the various other types of equipment referred to in application Ser. No. 560,699.

With this various devices the innermost structure, which supports the inner core and vibration absorbing material, is the shaft portion of the device.

Various features shown in one embodiment may be used with other embodiments including features described in Ser. No. 560,699 which are not otherwise described herein.

What is claimed is:

1. In a hand held article of equipment having an elongated handle which includes a shaft with a gripping area having a gripping surface to be gripped by the user in a squeezing action, the improvement being in an inner core around said shaft, a flexible vibration absorbing material around said inner core, said vibration absorbing material having an outer surface which comprises said gripping surface, said outer surface of said vibration absorbing material being the outermost surface of said handle at said gripping area, said vibration absorbing material having a hardness of less than about 40 durometer Class D durometer reading, said vibration absorbing material having a high coefficient of friction, said vibration absorbing material having a high dampening of vibration, said inner core having a plurality of integral spaced rigid projections forming a continuous series of peaks and valleys, the thickness of said vibration absorbing material at said valleys being greater than twice the thickness of said vibration absorbing material at said peaks, the outer ends of said peaks being closer to said outer surface than any other portions of said inner core is to said outer surface, said projections extending into said vibration absorbing material a substantial distance and in a pattern over a sufficient portion of the length of said gripping area to comprise means to provide rigidity during the use of said article, said projections being located inwardly of said outer surface of said vibration absorbing material, said vibration absorbing material and said inner core being secured together by said projections extending into said vibration absorbing material, said vibration absorbing material being distinct from said inner core and said projections, and said vibration absorbing material completely covering said projections to render said outer surface of said vibration absorbing material as the sole user contacting and gripping surface in said gripping area during use of said article.

2. The device of claim 1 wherein each of said projections extends longitudinally down the length of said gripping area.

3. The device of claim 1 wherein said coefficient of friction is at least 0.6, and said dampening of vibration is greater than 55%.

4. The device of claim 3 wherein said outer surface of said vibration absorbing material is tacky and non-porous and has a coefficient of friction of 0.6–1.0.

5. The device of claim 1 wherein said shaft and said inner core are of one piece construction.

6. The device of claim 1 wherein said article is a golf club.

7. The device of claim 1 wherein said handle is part of an article selected from the group consisting of golf clubs, javelins, racquets, sticks and bats.

8. The device of claim 1 wherein said inner core is in the form of an insert permanently and non-removably secured to said shaft.

9. In a hand held article of equipment having an elongated handle which includes a shaft with a gripping area having a gripping surface to be gripped by the user in a squeezing action, the improvement being in that said handle includes a sleeve around said shaft in said gripping area, an inner core around said sleeve, a flexible vibration absorbing material around said inner core, said vibration absorbing material having an outer surface which comprises said gripping surface, said vibration absorbing material having a hardness of less than about 40 durometer reading, said vibration absorbing material having a high coefficient of friction, said vibration absorbing material having a high dampening of vibration said inner core having a plurality of spaced rigid projections extending in a pattern over a sufficient portion of the length of said gripping area to provide rigidity during the use of said article, said projections being located inwardly of said outer surface of said vibration absorbing material, said vibration absorbing material and said inner core being secured together by said projections extending into said vibration absorbing material, said vibration absorbing material being distinct from said inner core and said projections, and said vibration absorbing material completely covering said projections to render said outer surface of said vibration absorbing material as the sole user contacting and gripping surface in said gripping area during use of said article.

10. The device of claim 9 wherein said inner core includes a plurality of spaced peaks and valleys, said peaks being said projections, and said material being of non-uniform thickness.

11. The device of claim 9 wherein said sleeve is of uniform thickness.

12. The device of claim 11 wherein said sleeve is heat shrunk onto said shaft.

13. The device of claim 9 including an adhesive between said sleeve and said inner core.

14. The device of claim 9 including an adhesive between said sleeve and said shaft.

15. The device of claim 9 wherein said inner core includes a recess at its outer end, and a cap mounted in said recess.

16. The device of claim 10 wherein each of said projections extends longitudinally down the length of said gripping area.

17. The device of claim 9 wherein said inner structure has a hardness durometer reading of 0.25–0.95.

18. The device of claim 9 wherein said coefficient of friction is at least 0.6, and said dampening of vibration is greater than 55%.

19. The device of claim 18 wherein said outer surface of said vibration absorbing material is tacky and non-porous and has a coefficient of friction of 0.6–1.0.

20. The device of claim 9 wherein said article is a golf club.

21. The device of claim 9 wherein said handle is part of an article selected from the group consisting of golf clubs, javelins, racquets, sticks and bats.

22. A method of forming a gripping surface on an elongated handle which includes a shaft comprising the steps of forming an inner core which includes a plurality of spaced rigid projections extending in a pattern over a length generally corresponding to the length of a gripping area, providing a flexible vibration absorbing material around the inner core to form a composite outer structure wherein the projections are located inwardly of the outer surface of the vibration absorbing material with the vibration absorbing material and inner core being secured together by the projections extending into the vibration absorbing material, sliding the composite outer structure down the handle completely past a location on the handle which is to be the gripping area, sliding a sleeve around the handle on the gripping area, heat shrinking the sleeve to secure the sleeve to the handle, sliding the composite outer structure up the handle until the composite outer structure is over the sleeve, and securing the composite outer structure to the sleeve forms whereby the outer surface of the vibration absorbing material the gripping surface of the handle.

23. The method of claim 22 wherein the composite outer structure has a recess at its remote end, and snapping a cap into the recess.

24. The method of claim 23 including providing an adhesive between the sleeve and the handle.

25. The method of claim 22 including providing an adhesive between the sleeve and the outer structure.

26. The method of claim 22 wherein the vibration absorbing material has a coefficient of friction of at least 0.6 and a dampening of vibration greater than 25% and a hardness of less than 60 durometer reading.

27. The method of claim 26 wherein the vibration absorbing material has a dampening of vibration greater than 55% and a hardness of less than 40 durometer reading.

* * * * *